United States Patent [19]

Platts

[11] 4,406,030

[45] Sep. 27, 1983

[54] PIPELINE SPHERES

[75] Inventor: Douglas J. Platts, Creswell, England

[73] Assignee: General Descaling Company Limited, Nottinghamshire, England

[21] Appl. No.: 316,909

[22] Filed: Oct. 30, 1981

[30] Foreign Application Priority Data

Oct. 31, 1980 [GB] United Kingdom ..... 8035067

[51] Int. Cl.[3] ..... B08B 9/04

[52] U.S. Cl. ..... 15/104.06 R

[58] Field of Search ..... 15/3.5, 3.51, 104.06 R, 15/104.06 A

[56] References Cited

U.S. PATENT DOCUMENTS 2,258,174 10/1941 Chawner ..... 15/104.06 R

FOREIGN PATENT DOCUMENTS 1230129 8/1968 United Kingdom .

359070 1/1973 U.S.S.R. ..... 15/104.06 R 660737 5/1979 U.S.S.R. ..... 15/104.06 R

*Primary Examiner*—Edward L. Roberts

*Attorney, Agent, or Firm*—Cushman, Darby & Cushman

[57] ABSTRACT

A sphere for use in the "pigging" of pipelines has a number of discrete areas of abrasive material (2) on its surface. The abrasive material may comprise a flexible backing provided with a multiplicity of upstanding spikes or fibres, mounted in shallow depressions in the surface of the sphere so that the free ends of the spikes or fibres may contact the pipeline wall. The shallow depressions accommodating the abrasive material are suitably interconnected by a network of shallow channels (3). The spheres (1) are of particular use in the "pigging" of lateral feeders to a main pipeline, wherein it may not be possible to use the cylindrical or piston form of pig.

4 Claims, 2 Drawing Figures

PIPELINE SPHERES

Figures 1, 2:
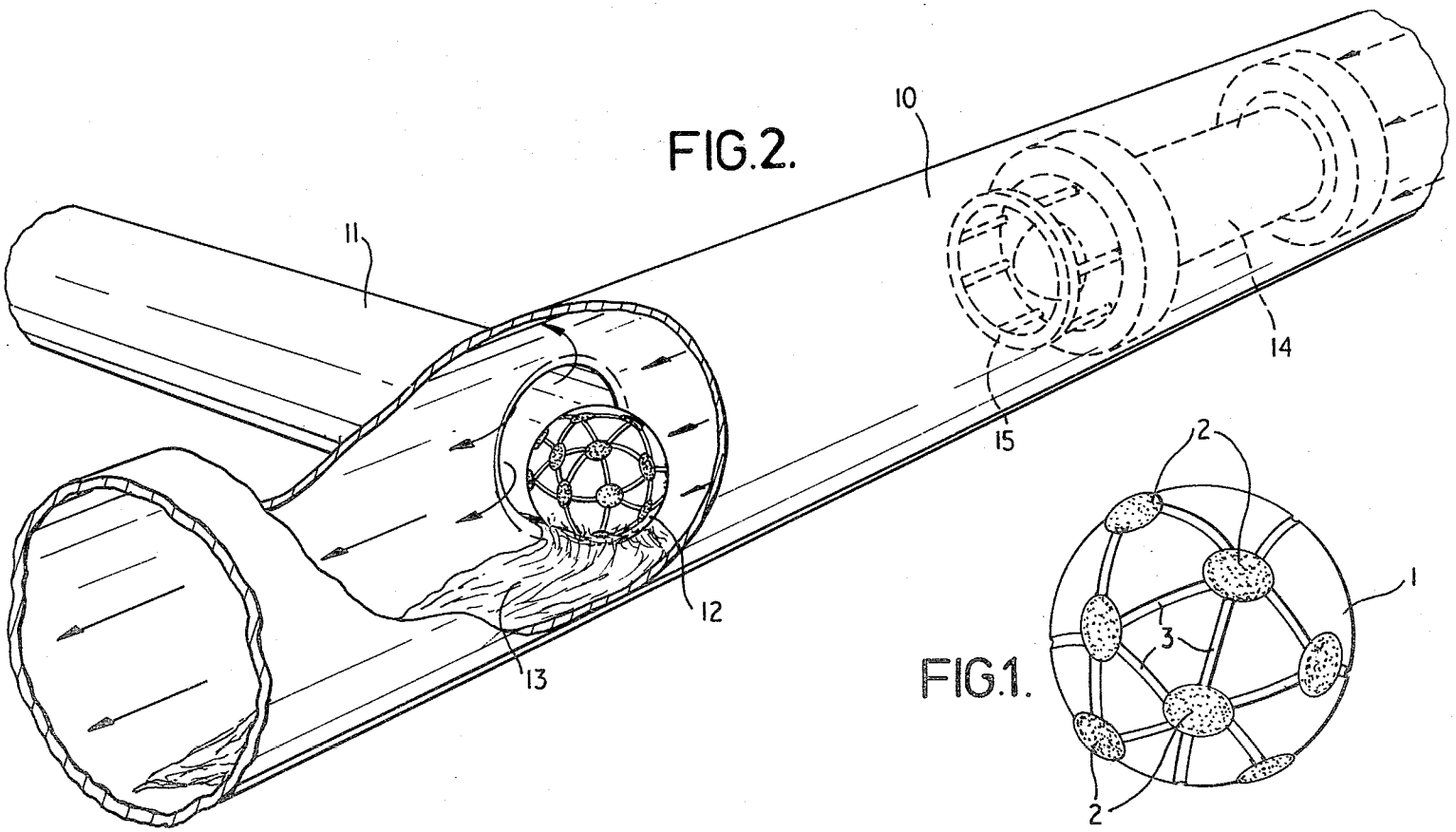

This invention relates to a novel pipeline sphere, to a method for the production thereof, and to the use of such a sphere in the "pigging" of pipelines.

Pipeline spheres (spheroids, ball-pigs etc.,) are hollow relatively thick-walled elastomeric spheres. They are filled and inflated with liquid (via suitable valves) so that they are incompressible but quite deformable. When introduced into a pipeline at a size approximate to the pipe bore (sometimes slightly less—usually a few percent more) they are propelled by the line fluid in a piston-like mode and can create an almost perfect travelling seal. Used singly or in combination they separate fluid phases or different products within a pipeline; these uses and their characteristics are widely familiar in the oil, gas, petrochemical and related industries, and they are commercially available from a variety of manufacturing techniques.

The use of basically cylindrical, piston-formed travellers, known generally as pipeline "pigs", is also of long standing and well-known. Such mechanical devices, with more-or-less rigid bodies and a definite axis of travel, can carry a variety of cleaning or scraping implements to do work on the pipeline interior with intent to dislodge and carry away waxes, scales, crystalline deposits and so on. There is an extremely wide range of construction and material used in the manufacture of these devices.

Pigs therefore are much more versatile of task than spheres but, because of their structure, are more limited in the types of pipeline internal geometry they can traverse. For such reasons, many modern installations make provision for the launching, passage and reception of both types of traveller.

In some cases the use of a pig is not practicable for many and diverse reasons. It has accordingly been a matter of regret that the sphere, an almost universal traveller, is not an efficient cleaner. In fact, consideration of a spherical shape within a clyinder will show that there is a greater tendency to compress and smooth material on to the pipe wall than to dislodge it.

A case in point occurs when a number of smaller pipelines act as feeders connecting and discharging into a common trunk line or extended manifold. As the latter for most of its length is significantly larger than the "lateral feeders", pigging of these is normally, on land, by separate smaller arrangements. This is not prectica-ble if the system is an undersea project. In that case it is useful if the smaller (lateral) traveller can simply be expelled into the main line at the junction. In the large line it would travel slowly, if at all, but can readily be recovered by "shunting" along with a larger mainline pig suitably prepared.

As the lateral feeders need cleaning, and as only spheres can be safely subjected to the above procedure, the need for a cleaning sphere is apparent. It is the object of the present invention to provide one.

According to the invention a sphere is furnished with cleaning devices around its periphery. Since a sphere completely enwrapped, for example, with a bristle or brush-like covering would lose its seal or drive characteristic, it is proposed that the cleaning, brushing or scraping elements be distributed over the surface of the sphere in the form of a series of discrete areas or "patches".

According to the invention therefore there is provided a sphere, the surface of which comprises discrete abrasive areas. Preferably these areas are arranged in a symmetrical array over the sphere surface, and preferably the total area of abrasive areas approximates to half of the total area of the sphere.

In order that the abrasive elements should not be crushed and damaged against the pipeline wall, and should survive, intact, a long journey as is frequently necessary, the areas of abrasive elements are preferably mounted in corresponding shallow depressions in the sphere surface, at such a level somewhat below the general surface that the tops of the abrasive elements, e.g. bristles, scrapers or the like, stand just proud of the general surface. It will be understood that these elements will be able to deflect as the travelling gyrations of the sphere bring each "patch" into proximity with the pipe wall.

In the design of cleaning pigs, it is desirable to have a degree of flow bypass around the cleaning elements, both to encourage local movement of dislodged material and, on the larger scale, to allow a slow differential movement of flow relative to the travelling pig, so that removed detritus does not form a solid plug in front but is steadily carried forward, relative to the pig, by the controlled "leak" provided by the bypass. A similar situation obtains with a sphere, which normally eliminates bypass, but which must have some relative flow if it is to be an effective cleaner. This may be provided by the flow which can occur between the abrasive patches, but in a preferred embodiment the individual shallow depressions around the sphere in which the abrasive elements are set are interconnected by a pattern of channels, formed e.g. by grooves or depressions in the sphere surface. The precise geometry of these is not important provided that a bypass continuity is observed. Thus a sphere in accordance with this embodiment, when inflated to correct size in the line and viewed along the pipe axis, would at any attitude present a pattern around the contact zone of alternate firm elastomer, active brush or the like abrasive element, and relief grooves to the sides of the latter. These grooves should suitably be of such pattern and continuity that fluid passing, from the rear, forward of the sphere (by virtue of the driving differential pressure) would find a complete path through the contact belt or zone and would be constrained to "flush" the areas of cleaning element in so doing.

A wide range of spikes, fibres, bristles, blades and the like, mounted in various ways, may be used as the abrasive or cleaning elements and the invention is not limited in this respect. A preferred material is one of a range of cloth carding strips familiar in the fabric industries. These suitably comprise a flexible backing furnished with protruding spikes of metallic or plastics material with characteristics varying from a soft "nap" to aggressive "talons". Material and style of these brush-like strips can be varied as required and the strips are both flexible and are suitably of compatible plastics moulding materials.

The flexibility facilitates arrangement around the sphere surface and also reduces strain in operation, and the materials can be arranged to mould harmoniously into the sphere.

Although separately-formed and applied abrasive elements are favoured, it will be understood that the abrasive or cleaning elements could be formed (within the pattern of depressions and interconnecting grooves)

by providing raised fingers or ribs in the sphere material itself, for example by integrally moulding them therein.

Many methods exist of making a hollow sphere in elastomeric material, the ideal being of a truly seamless unit (with the obvious virtues of integrity in the pipeline), and such may be used to make the spheres of the invention.

The following description is based on the use of a castable grade of polyurethane, which family of materials has many desired characteristics, but it will be understood that other tough but flexible elastomers may equally well be used.

The provision of a sphere having the features described above is achieved by forming in the interior of a female spherical mould the requisite pattern of depressions (to accommodate the tops of the abrasive elements) and ribs (to form the surface grooves) and by locating the cleaning elements in the depressions with, of course, the bristles or other active parts orientated outwardly.

The polyurethane subsequently cast or injected into the mould will then engage and bond to the inner surfaces of the abrasive elements in any suitable way and generally as familiar in the polyurethane industry, to give the strongest possible mechanical and chemical bond.

The mould itself must of course be in parts (preferably equal hemispheres) capable of being locked firmly together and of withstanding the moulding process, with suitable means of injecting the required volume of liquid resin.

A significant element in the production process is the means of formation of the inner cavity. In the present process the concentric spherical cavity in the centre of the sphere is produced by the partial filling of the "empty" female mould by the liquid material, and a controlled multiaxis tumbling of the mould to coat the interior with a uniform layer. Note that although this resembles a centrifugal casting process, centrifugal force is not intentionally involved. Speeds are not determined by centrifugal effects and it is the continuous tumbling motion which forms the uniform inside layer and which continues until the resin "gels". Thickness is determined by the volume of resin inserted. The mould is then removed for "curing" to continue, with heat if necessary, all as familiar in the art.

A valve of valves as familiar in pipeline spheres will be fitted into the mould halves for incorporation into the finished moulding.

A volume of air or gas under some low pressures is admitted to the inner cavity at some stage of the moulding process, and serves to press the relatively soft and weak "gel" wall into firm contact with the mould during curing. It will be understood that such internal gaseous pressure can have no effect when the resin fill is liquid, but can act as an inflation force when the wall is formed.

The elements of the tumbling device are familiar mechanical components and a very large number of variables can be entertained. A particular and useful form is described for reference.

The sphere mould, as described, is internally a truly spherical cavity but externally can be of any suitable shape, e.g. a cube with the eight solid corners "trimmed" to reduce overall dimensions.

The assembled mould is arranged to rotate on a horizontal axis between suitable bearing fitments analogous to the head-and tailstock of a lathe. The headstock incorporates a small hydraulic motor directly providing the rotative power. Both bearings are incorporated into opposing sides of a generally square frame, so that the mould rotates, for example, about a "North-South" axis across the square. On the other two sides the frame itself is provided with journals, cooperating with fixed stands, such that the frame can rotate about an "East-West" axis. The entire arrangement is a familiar double gimbal mounting. The mould (N-S) motor is supplied by pipes around the frame fed from swivel unions on the (E-W) journals. One of the latter incorporates in any convenient way a similar motor to drive the (E-W) rotation, in that case supplied from any external source of pressure energy.

If the two motors are connected in series flow (power not being a serious consideration) then they will rotate substantially in synchronism, and the mould will experience a uniform, if apparently complex, tumbling action to provide the internal core-less cavity.

In the drawing, FIG. 1 is a schematic representation of a sphere in accordance with the invention; FIG. 2 shows, in diagrammatic form, the use of a sphere as in FIG. 1 to "pig" the lateral feeder of a main pipeline.

Referring to FIG. 1, a hollow sphere 1 is made of an elastomeric material such as a polyurethane. Set into shallow depressions about its surface are elements 2 of abrasive material. These may for example be formed of a flexible backing moulded into the respective depression during the manufacturing process and provided with a multiplicity of upstanding spikes or fibres, the tips of the spikes or fibres standing proud of the adjacent surface of the sphere. The shallow depressions are interconnected by a network of shallow channels or grooves 3 moulded in the sphere surface.

Although the spheres of the invention are suitable for the cleaning of any type or size of pipeline, the size of the sphere being chosen accordingly, they are of especial use in the cleaning of lateral feeders to a main pipeline, in which, as mentioned at the outset, conventional "pigs" cannot be satisfactorily employed. FIG. 2 shows a main pipeline or manifold 10, e.g. a gas main, to which is joined a lateral feeder 11 of smaller diameter.

An abrasive or cleaning sphere 12 is shown emerging from the lateral 11, having removed from the internal surface thereof detritus 13.

The sphere 12 is pushed through the main pipeline 10 by means of a more conventional form of pig 14 having an annular nose 15 at its front end to contact the sphere 12.

I claim:

1. A spherical pig the surface of which comprises discrete areas of abrasive material, said discrete areas being interconnected by channels formed in the said surface, said channels permitting passage of liquid between said pig and a pipe in which said pig is moving.

2. A spherical pig as in claim 1 wherein said discrete areas are provided by mats of abrasive material set into shallow depressions in the surface of the sphere.

3. A spherical pig as in claim 2 wherein said mats of abrasive material each comprises a flexible backing to which is attached a plurality of upstanding fibrous elements.

4. A spherical pig for cleaning the inner surface of a pipe comprising a hollow spherical body of elastomeric material having a plurality of spaced-apart shallow depressions in its surface, each depression being interconnected with adjacent depressions by channels in the surface of the body, said channels having longitudinal dimensions extending across the spaces between depressions, and deflectable, upstanding, fibrous abrasive elements mounted in the depressions and having outer ends standing just proud of the surrounding surfaces of the body, said surrounding surfaces being free of abrasive elements, whereby when said pig travels through a pipe said abrasive elements are capable of dislodging detritus from the inner surface of the pipe and whereby said channels permit passage of fluid between said pig and the inner surface of the pipe.

* * * * *